US011589689B2

(12) United States Patent
McGill

(10) Patent No.: US 11,589,689 B2
(45) Date of Patent: Feb. 28, 2023

(54) DIVIDED SHELF FOR MODULAR GREETING CARD RACK

(71) Applicant: Vanguard Packaging, LLC, Kansas City, MO (US)

(72) Inventor: Apryl McGill, Kansas City, MO (US)

(73) Assignee: VANGUARD PACKAGING, LLC, Kansas City, MO (US)

( * ) Notice: Subject to any disclaimer, the term of this patent is extended or adjusted under 35 U.S.C. 154(b) by 0 days.

(21) Appl. No.: 16/896,503

(22) Filed: Jun. 9, 2020

(65) Prior Publication Data

US 2020/0383497 A1 Dec. 10, 2020

Related U.S. Application Data

(60) Provisional application No. 62/859,570, filed on Jun. 10, 2019.

(51) Int. Cl.
*A47F 5/11* (2006.01)
*A47F 5/00* (2006.01)

(52) U.S. Cl.
CPC ..... *A47F 5/116* (2013.01); *A47F 5/005* (2013.01)

(58) Field of Classification Search
CPC .. A47F 5/116; A47F 5/112; A47F 5/10; A47F 5/101; A47F 5/11; A47F 5/114; A47F 5/0018; A47F 5/0025; A47F 7/0028; A47F 5/005; A47F 7/144; A47F 5/132; A47F 5/108; A47F 7/145; A47B 43/02; A47B 47/06; A47B 55/06; A47B 43/00
USPC ..... 211/135, 150
See application file for complete search history.

(56) References Cited

U.S. PATENT DOCUMENTS

| | | | | |
|---|---|---|---|---|
| 235,381 | A | 12/1880 | Rohlfs | |
| 2,062,165 | A | 11/1936 | Davidson | |
| 2,578,060 | A | 12/1951 | Grant | |
| 2,883,098 | A * | 4/1959 | Horner | B65D 5/48002 229/120.13 |
| 2,918,178 | A | 12/1959 | Leone | |
| 3,139,192 | A | 6/1964 | Maguire | |
| 3,195,798 | A | 7/1965 | Wilson | |
| 3,362,610 | A | 1/1968 | Van Dyke | |
| 3,987,737 | A | 10/1976 | Smith | |
| 4,228,904 | A | 10/1980 | Dumond | |
| 4,341,338 | A | 7/1982 | Arnold | |
| 4,383,636 | A | 5/1983 | Chaffers | |
| 4,427,108 | A | 1/1984 | Coles et al. | |
| 4,458,838 | A | 7/1984 | Lacasa et al. | |

(Continued)

FOREIGN PATENT DOCUMENTS

| | | |
|---|---|---|
| DE | 3824930 A1 | 1/1990 |
| GB | 1188834 A | 4/1970 |

OTHER PUBLICATIONS

"Final Office Action Received For U.S. Appl. No. 15/956,575 dated Jan. 4, 2019, 10 Pages.".

(Continued)

*Primary Examiner* — Devin K Barnett
(74) *Attorney, Agent, or Firm* — Kutak Rock LLP

(57) ABSTRACT

A divided shelf for a display rack and related methods are provided. The divided shelf transforms from a knockdown configuration to an erected configuration. The divided shelf includes divider panels to divide the shelf into more than one separate compartments. The divided shelf is affixed to a display rack base.

13 Claims, 6 Drawing Sheets

(56) References Cited

U.S. PATENT DOCUMENTS

| | | | | |
|---|---|---|---|---|
| 4,506,790 | A | 3/1985 | Muscari | |
| 4,519,319 | A | 5/1985 | Howlett | |
| 4,567,996 | A | 2/1986 | Muise | |
| 4,646,922 | A | 3/1987 | Smith | |
| 4,871,067 | A | 10/1989 | Valenti | |
| 5,016,545 | A | 5/1991 | Robertson et al. | |
| 5,145,244 | A | 9/1992 | Kersting et al. | |
| 5,190,211 | A | 3/1993 | Stoddard et al. | |
| 5,193,466 | A | 3/1993 | Eder | |
| 5,213,220 | A | 5/1993 | McBride | |
| 5,253,769 | A | 10/1993 | Vlastakis | |
| 5,277,360 | A | 1/1994 | Demott | |
| 5,301,800 | A | 4/1994 | Kenney | |
| 5,315,936 | A | 5/1994 | Smith | |
| 5,316,210 | A | 5/1994 | Scullin | |
| 5,333,777 | A | 8/1994 | Roth | |
| 5,702,011 | A | 12/1997 | Carroll | |
| 5,706,959 | A | 1/1998 | Smith | |
| 5,775,573 | A * | 7/1998 | Smith | A47F 5/005 206/757 |
| 5,826,732 | A | 10/1998 | Ragsdale | |
| 5,966,857 | A | 10/1999 | Pettersson et al. | |
| 6,068,140 | A | 5/2000 | Mangrum et al. | |
| 6,098,820 | A | 8/2000 | Smith | |
| 6,126,254 | A | 10/2000 | Maglione | |
| 6,347,772 | B1 | 2/2002 | L'Hotel | |
| 6,378,710 | B1 | 4/2002 | Grueneberg | |
| 6,457,421 | B1 | 10/2002 | Apichom | |
| 6,508,023 | B2 | 1/2003 | Moss et al. | |
| 6,612,669 | B2 | 9/2003 | Grueneberg | |
| 6,715,623 | B2 | 4/2004 | Broerman | |
| 7,007,615 | B2 | 3/2006 | Grueneberg | |
| 7,066,342 | B2 | 6/2006 | Baechle et al. | |
| 7,111,735 | B2 | 9/2006 | Lowry | |
| 7,137,517 | B2 | 11/2006 | Lowry et al. | |
| 7,252,200 | B1 | 8/2007 | Hester | |
| 7,281,648 | B2 | 10/2007 | Lowry | |
| 7,546,927 | B2 | 6/2009 | Lowry et al. | |
| 7,634,865 | B2 | 12/2009 | L'Hôtel | |
| 7,753,218 | B2 | 7/2010 | Moss et al. | |
| 8,376,213 | B2 | 2/2013 | Brand | |
| 8,596,518 | B2 | 12/2013 | Babcock | |
| 9,212,019 | B2 * | 12/2015 | Frost | A47F 7/147 |
| 9,578,978 | B2 | 2/2017 | Frost | |
| 9,986,856 | B1 | 6/2018 | Frost | |
| 10,390,634 | B2 | 8/2019 | Frost | |
| 2002/0108541 | A1 | 8/2002 | Grueneberg | |
| 2003/0160015 | A1 | 8/2003 | Broerman | |
| 2005/0067321 | A1 | 3/2005 | Pitts et al. | |
| 2006/0213851 | A1 | 9/2006 | Grueneberg | |
| 2007/0235396 | A1 | 10/2007 | Moss et al. | |
| 2008/0030113 | A1 | 2/2008 | Vail | |
| 2008/0067301 | A1 | 3/2008 | Moss | |
| 2008/0083682 | A1 | 4/2008 | Moss et al. | |
| 2008/0169340 | A1 | 7/2008 | Sheffer | |
| 2009/0140118 | A1 | 6/2009 | Moss et al. | |
| 2010/0236117 | A1 | 9/2010 | Mestres Armengol et al. | |
| 2012/0012734 | A1 | 1/2012 | Tzuo | |
| 2013/0213915 | A1 | 8/2013 | Pfeifer et al. | |
| 2018/0235381 | A1 | 8/2018 | Frost | |
| 2019/0343301 | A1 | 11/2019 | Frost | |

OTHER PUBLICATIONS

"Final Office Action received for U.S. Appl. No. 14/146,130 dated Apr. 30, 2015, 24 pages".
"Final Office Action received for U.S. Appl. No. 14/968,352 dated Jul. 29, 2016, 17 page".
"Final Office Action received for U.S. Appl. No. 15/363,256 dated Jul. 3, 2017, 22 pages".
"Final Office Action received for U.S. Appl. No. 16/520,270, dated Apr. 21, 2020, 14 Pages".
"Non Final Office Action received for U.S. Appl. No. 15/956,575, dated May 31, 2018, 10 pages".
"Non Final Office Action Received For U.S. Appl. No. 16/520,270, dated Aug. 22, 2019, 28 Pages.".
"Non-Final Office Action received for U.S. Appl. No. 14/146,130 dated Sep. 2, 2014, 14 pages".
"Non-Final Office Action received for U.S. Appl. No. 14/968,352 dated Jan. 11, 2016, 23 pages".
"Non-Final Office Action received for U.S. Appl. No. 15/363,256 dated Dec. 16, 2016, 33 pages".
"Notice of Allowance Received for U.S. Appl. No. 15/363,256 dated Nov. 30, 2017".
"Notice of Allowance received for U.S. Appl. No. 14/146,130 dated Aug. 10, 2015, 14 pages".
"Notice of Allowance received for U.S. Appl. No. 14/968,352 dated Nov. 15, 2016, 33 pages".
"Notice of Allowance Received for United States U.S. Appl. No. 15/956,575, dated Apr. 17, 2019, 5 pages", Aug. 23, 2018.
"Notice of Allowance Received for U.S. Appl. No. 14/968,352 dated Nov. 15, 2016".

* cited by examiner

DIVIDED SHELF FOR MODULAR GREETING CARD RACK

PRIORITY CLAIM

The instant application claims priority to U.S. provisional patent application No. 62/859,570, which was filed on 10 Jun. 2019, which is incorporated by reference in its entirety.

FIELD

Embodiments of the present invention relate generally to the field of point of purchase merchandise displays. More particularly, embodiments of the present invention relate to a corrugated, paperboard display that is manufactured in a fold and/or glue assembly process and that is traditionally provided to an end user in a collapsed or knockdown configuration for setup. More specifically, embodiments of the present invention relate to a particular shelf for a corrugated, paperboard display.

RELATED APPLICATIONS

Some examples of corrugated, paperboard displays with which the present invention may be used are disclosed in U.S. patent application Ser. No. 15/956,575, filed Apr. 18, 2018, now U.S. Patent Publication No. 2018/0235381, which is a continuation application of U.S. patent application Ser. No. 15/363,256, filed Nov. 29, 2016, now U.S. Pat. No. 9,986,856, which is a continuation application of U.S. patent application Ser. No. 14/968,352, filed Dec. 14, 2015, now U.S. Pat. No. 9,578,978, which is a continuation application of U.S. patent application Ser. No. 14/146,130, filed Jan. 2, 2014, now U.S. Pat. No. 9,212,019, which claims priority benefit, with regard to all common subject matter, of earlier-filed U.S. Provisional Patent Application No. 61/748,672, filed Jan. 3, 2013, and entitled "MODULAR GREETING CARD RACK," each of which are hereby incorporated by reference in their entirety into the present provisional application.

BACKGROUND

Corrugated displays and containers are often made from pieces of flat paperboard stock material that are die cut into shapes that define various panels. The shapes are folded along predefined lines (i.e., fold lines) between the panels with at least one overlapping strip or panel that is glued, taped or otherwise affixed to another panel to form an enclosed boundary. The panels are folded and/or glued into place to become the walls of the display or container. The displays or containers are traditionally provided to product manufacturers and/or retailers in a collapsed or knock-down configuration for storage, handling and shipping. The manufacturer and/or retailers open the knockdown containers and fold appropriately to utilize the assembled display or container for display and/or packing products therein.

The knockdown displays or containers are typically manufactured by feeding flat die cut sheets through a fold-and-glue machine. The fold-and-glue machine applies adhesive and folds over select panels so that the panels are in the knockdown configuration. One common knockdown display is a multi-shelved greeting card rack style display. A corrugated card rack display is typically used to display products, such as greeting cards, to consumers at a point-of-sale location. It is desirable to minimize the time and effort necessary to manufacture the card rack display and to erect the display from its knockdown configuration. Conventional, corrugated card rack displays often include shelves made using a single sheet of corrugated that "accordions" to make multiple shelves. This adds considerably to assembly labor and time as well as to material and labor costs for manufacturing the container. Thus, it would be beneficial to provide a card rack style display that reduces labor and material costs.

SUMMARY

Embodiments of the present invention include a shelf for use with a rack display. The divided shelf includes at least one divided shelf member with horizontal and vertical tabs. The shelf member also includes one or more dividers such that when erected the divided shelf member provides more than one compartment separated by the divider(s). The divided shelf member is secured to a rack display base by inserting the vertical and horizontal tabs within vertical and horizontal slots on the display rack base.

Embodiments of the present invention also include a method of making a divided shelf member for a display rack, which includes the steps of: forming a rack display base that includes horizontal and vertical slots; and forming one or more divided shelf members that are capable of being secured to the front panel of the base, with each of the divided shelf members including horizontal and vertical tabs and each of the shelf members including dividers that separate more than one shelf compartment. In such a method, the horizontal tabs are configured to be inserted within the horizontal slots and the vertical tabs are configured to be inserted within the vertical slots.

Embodiments of the present invention additionally include a method of erecting a divided shelf member for a rack display, which includes the initial step of providing the divided shelf in a knockdown configuration. The divided shelf member includes one or more shelf members, with the shelf members having one or more horizontal tabs and one or more vertical tabs. The shelf members also include dividers that separate more than one compartment of the shelf when the shelf is erected. The method additionally includes the steps of: folding the divided shelf members from the knockdown configuration to expand the dividers creating more than one separate compartments on each divided shelf member; and inserting the horizontal tabs of the divided shelf members within horizontal slots of a front panel of a display rack base; and inserting the vertical tabs of the divided shelf member(s) within vertical slots of a front panel of a display rack base.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of embodiments and the accompanying drawing figures.

BRIEF DESCRIPTION OF THE DRAWING FIGURES

Embodiments of the present invention are described below with reference to the attached drawing figures, wherein:

FIG. 1 is a plan view of a divided shelf member according to embodiments of the present invention;

FIG. 1*a* is an exploded view of a section of the divided shelf member of FIG. 1;

FIG. 1*b* is an exploded view of another section of the divided shelf member of FIG. 1;

Figure 1:
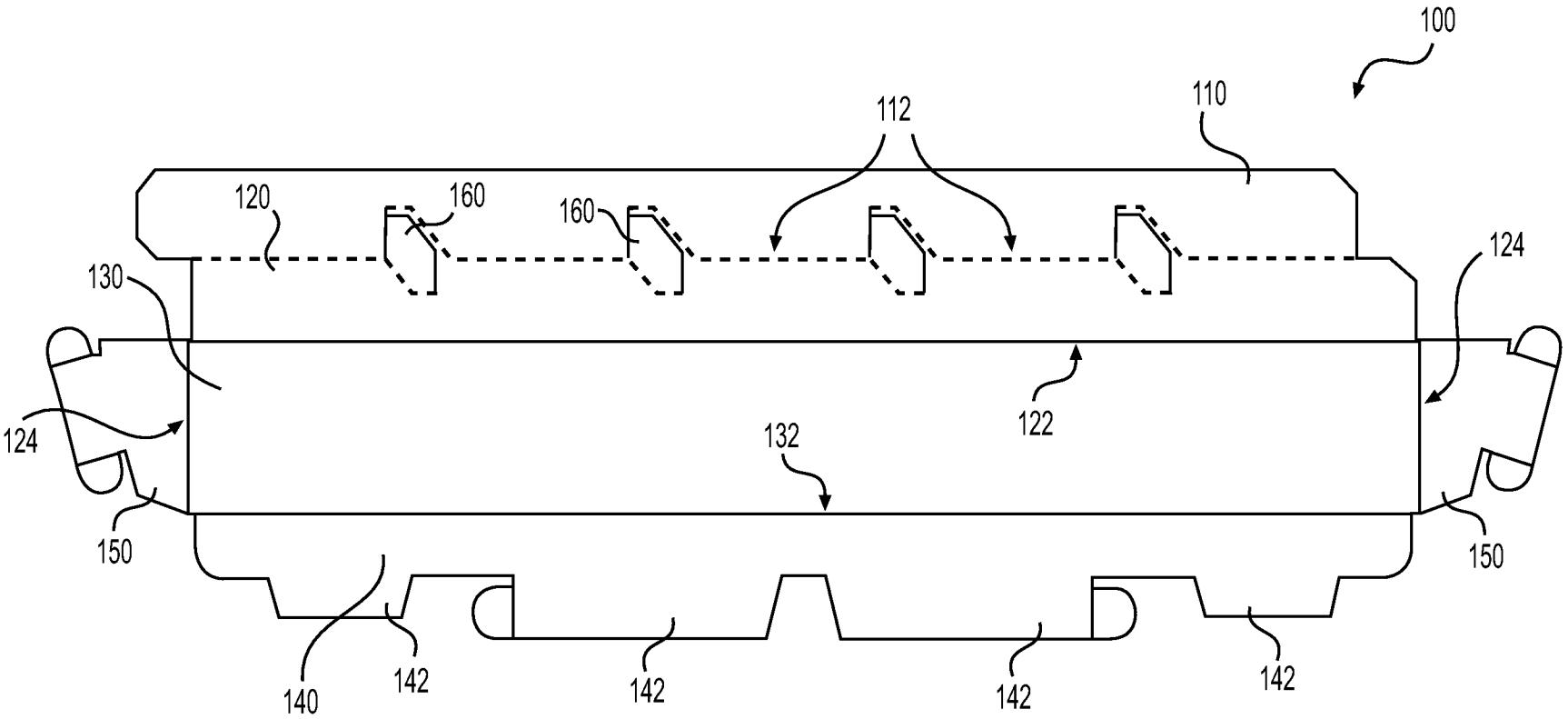

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments but is not necessarily included. Thus, the present technology can include a variety of combinations and/or integrations of the embodiments described herein.

As used herein, direction or relational terms such as "front," "back," "left," "right," "top," and "bottom" are used as an aid to the reader in place of less visual terms such as "first" and "second." Such terms are used in the context of a user viewing embodiments of the present invention from a front view. Similarly, the term "longitudinal" generally refers to an orientation or direction relative to an axis of elongation, whereas "lateral" refers to an orientation or direction that is generally perpendicular to the axis of elongation.

Figure 2:
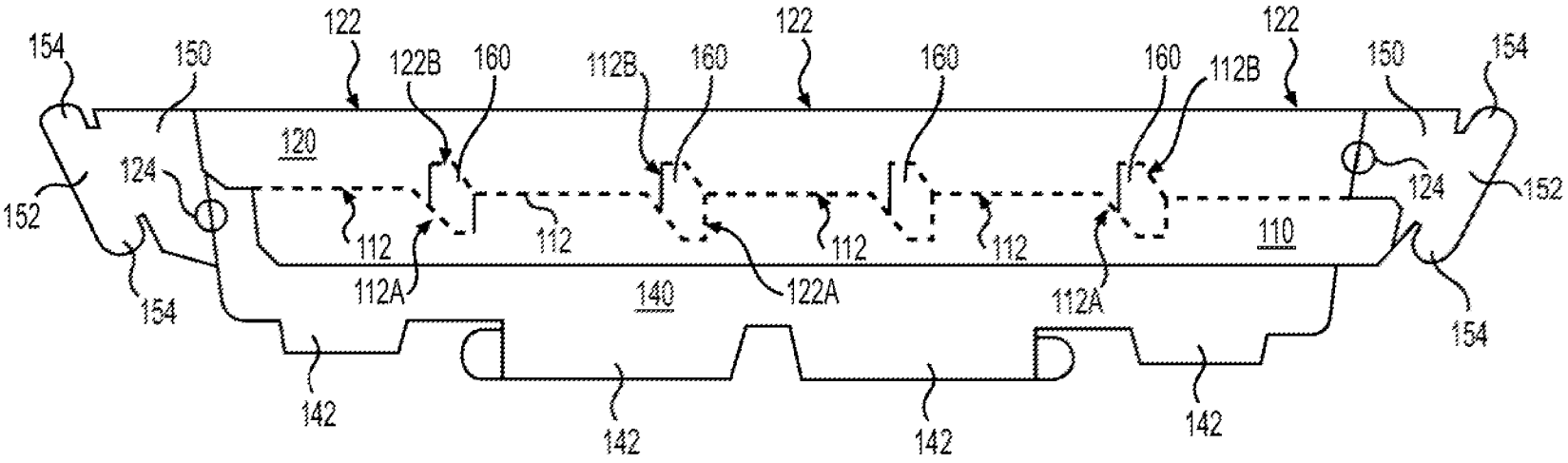
FIG. 2 is a plan view of the divided shelf member from FIG. 1, with the shelf member in the knockdown configuration.
Figure 3:
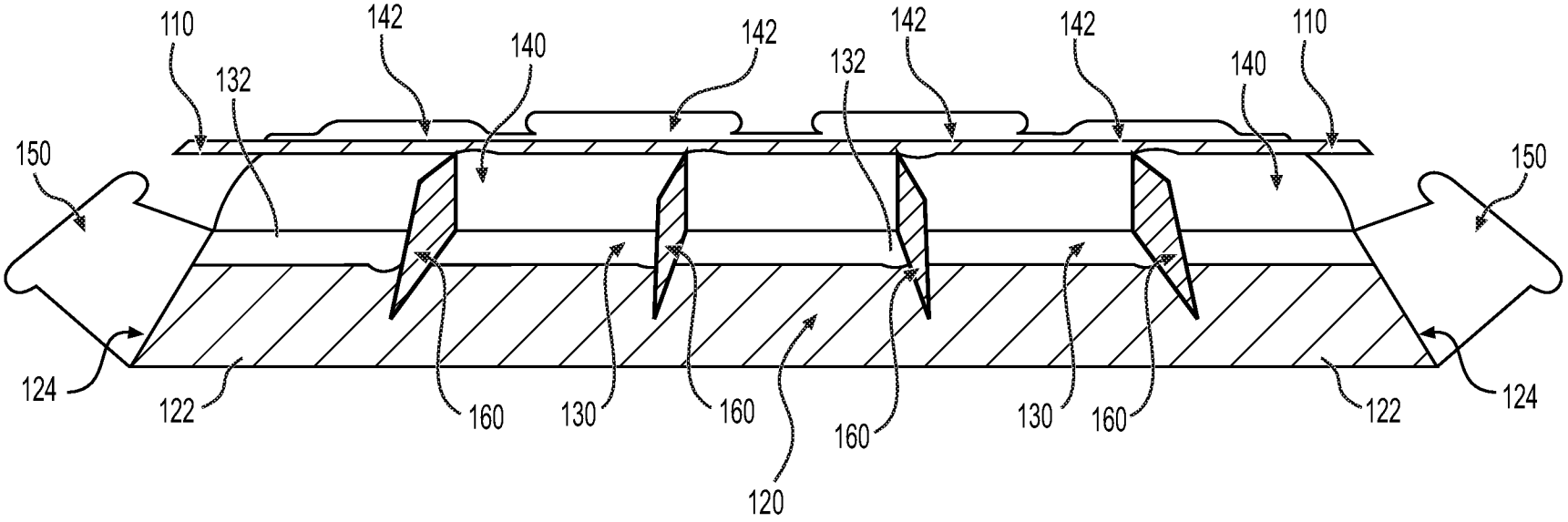
FIG. 3 is a top partial perspective view of the divided shelf member from FIG. 1, with the shelf member completely folded in the erected configuration.
Figure 4:
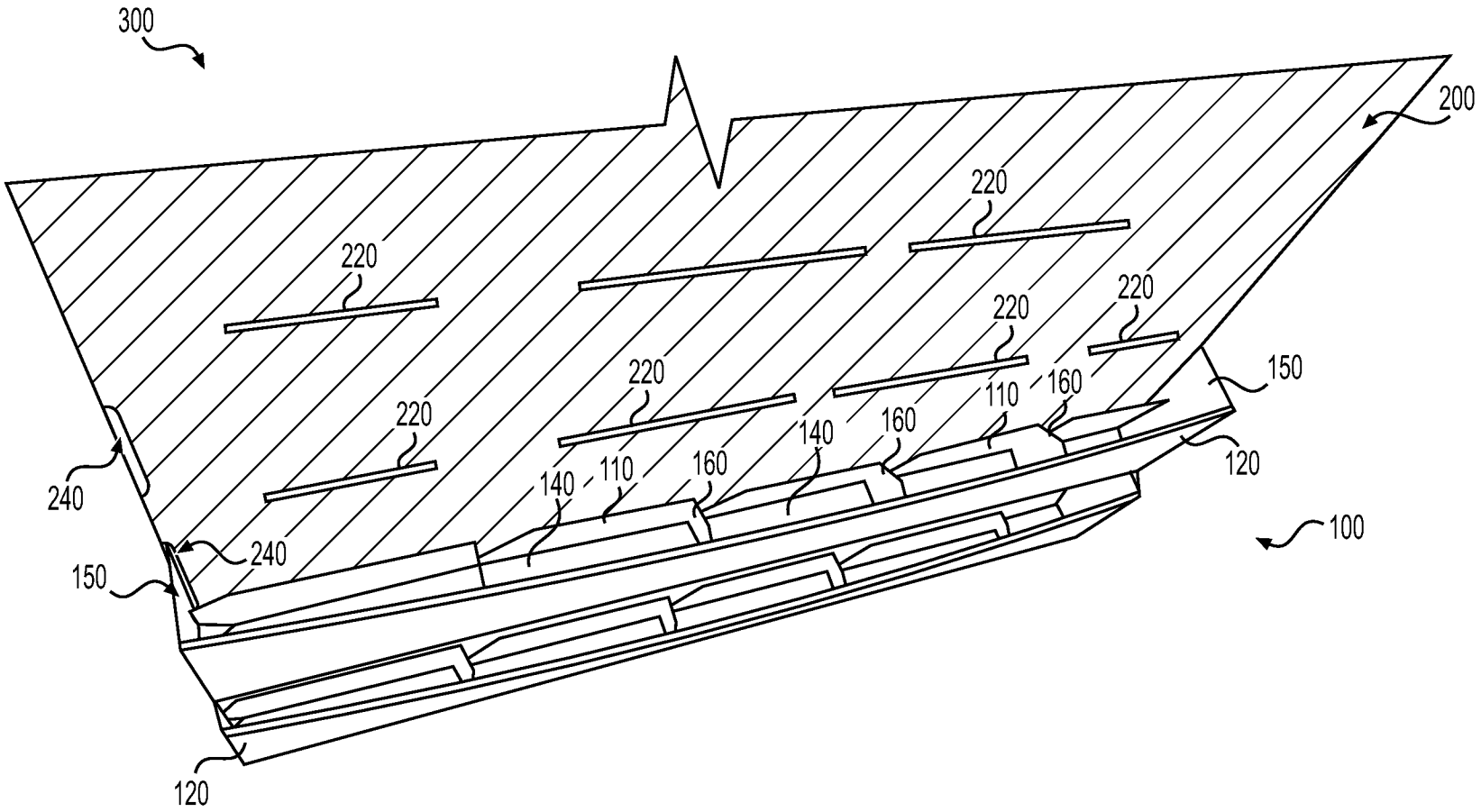
FIG. 4 is a perspective view of the divided shelf member from FIG. 1 in the erected configuration and secured to a rack display base.

As shown in FIG. 4, embodiments of the present invention include a divided shelf member 100 for accommodating and displaying products such as, for instance, cards, magazines, books, or the like. In certain embodiments, the divided shelf member is formed from corrugated material, such as paperboard. However, other embodiments provide for the corrugated material to include other similar type materials, such as cardboard, fiberboard, or the like. The divided shelf is operable to be provided in a knockdown configuration (i.e., a generally flat, two-dimensional form), such as illustrated in FIGS. 1-2. From the knockdown configuration, the divided shelf is operable to be transformed into an erected configuration, such as shown in FIGS. 3-4.

Referring to FIG. 1, an embodiment of the present invention is shown. The divided shelf member 100 includes an outer panel 130 separated by a fold line 122 from an inner panel 110/120. The outer panel includes side panels 150 that extend from sides of the outer panel and that are separated from the outer panel via side panel fold lines 124. In certain embodiments, the side panels 150 include vertical tabs 152 with tab fingers that extend from sides of the side tabs and that are capable of folding about the tabs via vertical tab finger fold lines 156. The vertical tab fingers 154 are used to provide additional support and securement for the divided shelf members 100 as they are attached to a display rack base 200. In certain embodiments, the shelf members additionally include a tab panel 140 that extends from the outer panel 130 and that is separated from the outer panel via an outer panel fold line 132. As will be described in further detail below, the tab panel 140 operates as the shelf floor or bottom when in the erected configuration. In some embodiments, the tab panel has one or more horizontal tabs 142 extending therefrom. In certain embodiments, the tab panel has one, two, three, four, five or more tabs extending therefrom. However, other embodiments provide for the tab panel to have more or less than three tabs. In certain embodiments of the present invention, the number of horizontal tabs of the tab panel corresponds to the number of horizontal slots 220 on a row of horizontal slots on a display rack base 200 (see FIG. 4). In even further embodiments, one or more of the horizontal tabs of the tab panel include horizontal tab fingers 144 that extend from sides of the horizontal tabs and are capable of folding with respect to the horizontal tabs along horizontal tab finger fold lines 146.

Figure 1A:
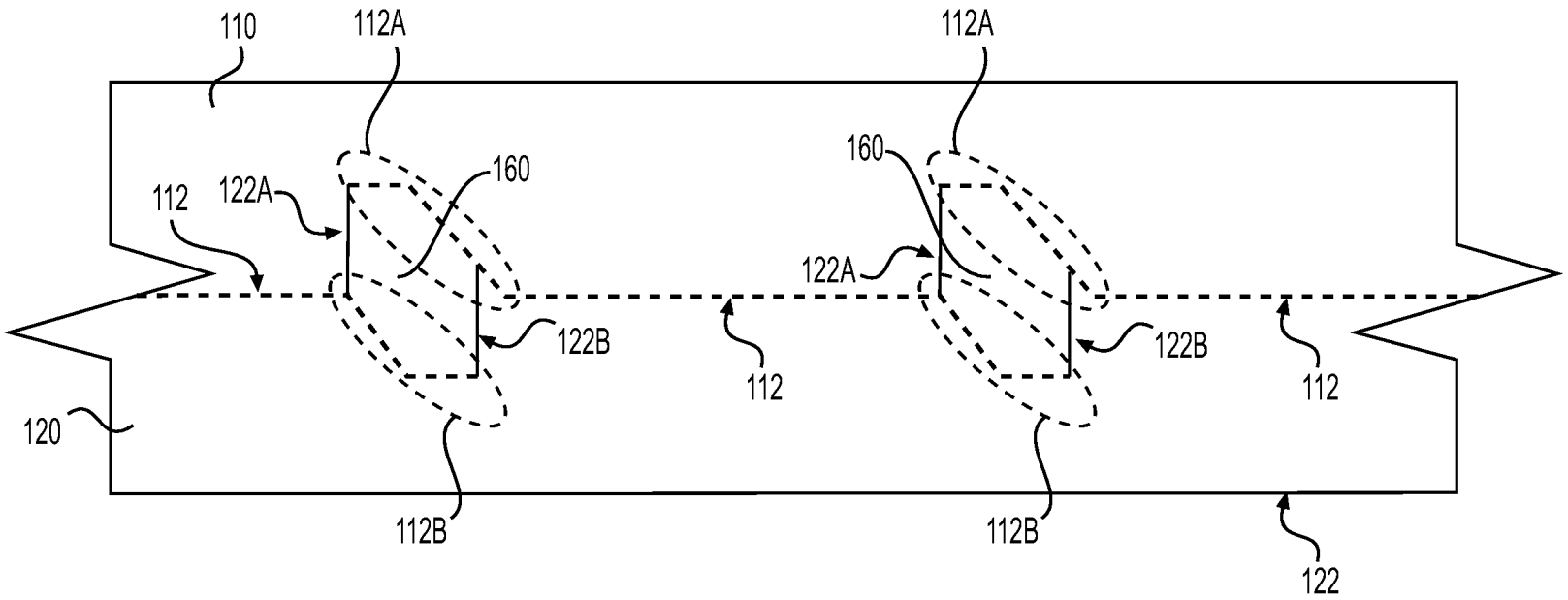
Figure 1B:
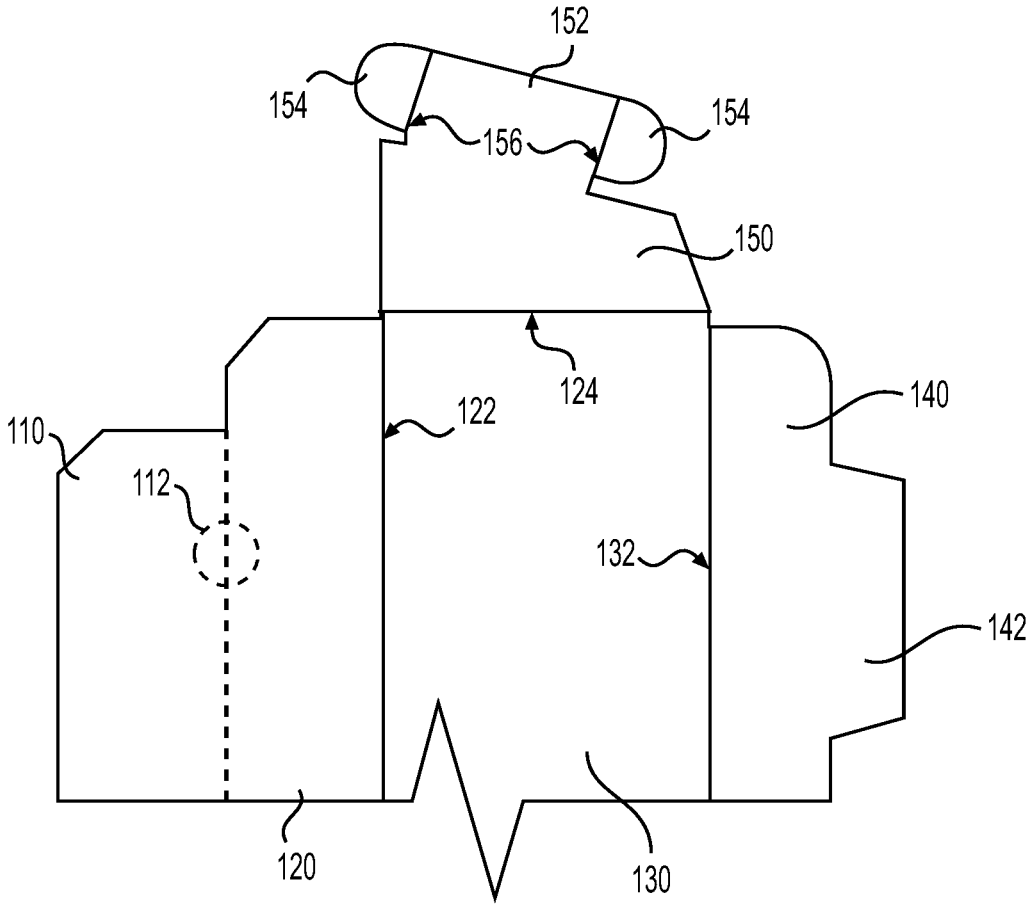

Still referring to FIG. 1, the inner panel includes a proximal inner panel 120, one or more divider panels 160, and a distal panel 110. The proximal and distal inner panels are proximal and distal with respect to the outer panel 130. In other words, the proximal inner panel is separated by an inner panel fold line 122 from the outer panel 130 and the distal inner panel 110 is farther away from the outer panel than the proximal inner panel 120. Referring also to FIG. 1*a*, the proximal inner panel 120 is separated from each of the one or more divider panels 160 by a proximal divider fold line 122B. The distal inner panel 110 is separated from each of the one or more divider panels 160 by a distal divider fold line 122A. The distal inner panel is separated from the proximal inner panel by the one or more divider panels and inner panel cut line 112. The distal edge of each divider panel 160 is separated from the distal inner panel 110 by a distal divider cut line 112A that is continuous with the inner panel cut line 112. The proximal edge of each divider panel 160 is separated from the proximal inner panel 120 by a proximal divider cut line 112B that is continuous with the inner panel cut line 112. In some embodiments, a strip of adhesive glue is applied to the proximal inner panel. In other embodiments, a strip of adhesive glue is applied to the outer panel 130 near the inner panel fold line 122 separating the outer panel and the proximal inner panel.

Referring to FIG. 2, the divided shelf is folded along the inner panel fold line 122 separating the outer panel 130 and the proximal inner panel 120. The proximal inner panel is glued to the outer panel. Neither the divider panels 160 nor the distal inner panel 110 are glued to the outer panel 130. The divided shelf member shown in FIG. 1 is a first knockdown configuration. The divided shelf member shown in FIG. 2 is a second or alternate knockdown configuration.

In operation, and with reference to FIG. 3, the divided shelf is capable of being transformed in a simple and quick manner from the knockdown configuration of FIGS. 1-2 to the erected configuration illustrated in FIGS. 3-4. To begin, if the divided shelf is in the first knockdown configuration as shown in FIG. 1, the inner panel 110/120 is folded about the inner panel fold line 122 separating the proximal inner panel 120 and the outer panel 130 such that the divided shelf member is then in the second or alternate knockdown configuration as shown in FIG. 2. The inner panel and outer panel are secured together by glue or other adhesive. In some embodiments, the outer and inner panels are glued together during manufacture and before shipping to the end user. In other embodiments, the outer and inner panels are glued together during erection of the divided shelf. When the divided shelf member is in the second or alternate knockdown configuration as shown in FIG. 2, the distal inner panel 110 is folded away from the proximal inner panel 120 by folding along each of the proximal divider fold lines 122B separating the proximal inner panel 120 and divider panels 160 and also folding along each of the distal divider fold lines 122A separating the divider panels and the distal inner panel 110, as shown in FIG. 3. When folding the distal inner panel 110 away from the proximal inner panel 120, they both remain generally parallel to one another. The divider panels 160 are generally parallel to the inner panel 110/120 when the divided shelf member is in the knockdown configuration, as shown in FIGS. 1-2, and the divider panels are generally orthogonal to the inner panel when the division shelf member is in the erected configuration, as shown in FIGS. 3-4. As shown in FIG. 4, the divider panels separate the divided shelf member into more than one separate compartments for displaying product.

Next, the side panels 150 are folded about the side panel fold lines 124 separating each side panel from the outer panel 130, until the side panels are generally perpendicular with the outer panel and the inner panel. Here, the outer panel is glued to the proximal inner panel. Similarly, the tab panel 140 is folded about the outer panel fold line 132 separating the tab panel 140 from the outer panel 130, until the tab panel is generally perpendicular with the outer panel, the inner panel, and the divider panels. Finally, the vertical tab fingers 154 on the vertical tabs 152 and the horizontal tab fingers 144 of the horizontal tabs 142 are folded at the vertical tab finger fold line 156 and horizontal tab finger fold line 146, respectively, against the respective tabs. In such an erected position, the divided shelf members 100 are configured for insertion and/or securement to the display rack base 200 of a display rack 300.

Turning to FIG. 4, with the divided shelf members 100 secured to a display rack base 200, the display rack 300 is in an erected configuration. As such the rack display with one or more divided shelf is capable of being utilized to hold and display various products, such as cards, magazines, books, or the like, which each shelf being divided into more than one separate compartments. To transform the divided shelf member from its erected configuration to its knockdown configuration, a user performs the steps described above in reverse order.

Although the invention has been described with reference to the embodiments illustrated in the attached drawing figures, it is noted that equivalents may be employed, and substitutions made herein without departing from the scope of the invention as recited in the claims.

What is claimed is:

1. A divided shelf comprising:

(a) an outer panel hingedly coupled to an inner panel;

(b) side panels hingedly coupled to opposed ends of said outer panel;

(c) a tab panel hingedly coupled to said outer panel, said tab panel comprising one or more horizontal tabs extending from an outer edge of said tab panel; and (d) a vertical tab extending from an outer edge of each of said side panels, wherein said vertical tabs are each formed with tab fingers extending from opposed sides of each vertical tab, wherein each tab finger is hingedly coupled to its respective vertical tab such that said tab fingers are capable of being folded with respect to said vertical tabs, wherein said inner panel is folded 180 degrees and fixed to said outer panel to form a vertical panel, and wherein said vertical panel comprises said outer panel and said inner panel, said side panels extending from said outer panel, wherein said inner panel comprises a proximal inner panel, a distal inner panel, and one or more divider panels.

2. The divided shelf of claim 1, wherein said proximal inner panel is hingedly connected to said outer panel.

3. The divided shelf of claim 2 comprising at least two or more cut lines located between the proximal inner panel and the distal inner panel, wherein at least one of said at least two or more cut lines extends between the proximal inner panel and a proximal edge of one of said one or more divider panels, and wherein at least another of said at least two or more cut lines extends between the distal inner panel and a distal edge of the one of said one or more divider panels.

4. The divided shelf of claim 3 comprising a first fold line between the proximal inner panel and the outer panel; a second fold line between the outer panel and the tab panel; two third fold lines, each positioned between a side panel and the outer panel; at least one fourth fold line between a proximal edge of one of said one or more divider panels and the proximal inner panel; and at least one fifth fold line between a distal edge of one of said one or more divider panels and the distal inner panel, wherein each of said first through fifth fold lines serve as a hinge between adjacent corresponding panels.

5. The divided shelf of claim 1 comprising one or more horizontal tab finger on one or more of said one or more horizontal tabs.

6. The divided shelf of claim 4 comprising a glue strip on said outer panel proximate to said first fold line.

7. The divided shelf of claim 4 comprising a glue strip on said proximal inner panel proximate to said first fold line.

8. The divided shelf of claim 4, wherein the divided shelf is unfolded and in a single plane.

9. The divided shelf of claim 6, wherein the divided shelf is folded at the first fold line and in a single plane, and the proximal inner panel is glued to the outer panel.

10. The divided shelf of claim 7, wherein the divided shelf is folded at the first fold line and in a single plane, and the proximal inner panel is glued to the outer panel.

11. The divided shelf of claim 9, wherein (i) the tab panel is orthogonal to the outer panel, (ii) each side panel is orthogonal to the outer panel, (iii) the proximal inner panel is orthogonal to each of said one or more divider panels, and (iv) the distal inner panel is orthogonal to each of said one or more divider panels.

12. The divided shelf of claim 10, wherein (i) the tab panel is orthogonal to the outer panel, (ii) each side panel is orthogonal to the outer panel, (iii) the proximal inner panel is orthogonal to each of said one or more divider panels, and (iv) the distal inner panel is orthogonal to each of said one or more divider panels.

13. A display rack comprising:

(a) a display rack base comprising (i) two or more vertical slots, and (ii) two or more horizontal slots; and (b) a divided shelf member comprising (i) an outer panel hingedly coupled to an inner panel;

(ii) side panels hingedly coupled to opposed ends of said outer panel;

(iii) a tab panel hingedly coupled to said outer panel, said tab panel comprising one or more horizontal tabs extending from an outer edge of said tab panel; and (iv) a vertical tab extending from an outer edge of each of said side panels, wherein each vertical tab is inserted into one of said two or more vertical slots, and each of said one or more horizontal tabs is inserted into one of said two or more horizontal slots, wherein said vertical tabs are each formed with tab fingers extending from opposed sides of each vertical tab, wherein each tab finger is hingedly coupled to its respective vertical tab such that said tab fingers are capable of being folded with respect to said vertical tabs so as to enable said vertical tabs to be inserted into respective vertical slots, wherein each set of tab fingers is capable of being unfolded so as to retain said vertical tabs within respective vertical slots, thereby securing said first shelf member to said display rack base;

wherein said inner panel is folded 180 degrees and fixed to said outer panel to form a vertical panel, wherein said vertical panel comprises said outer panel and said inner panel, said side panels extending from said outer panel; and wherein said inner panel comprises a proximal inner panel, a distal inner panel, and one or more divider panels, said proximal inner panel being separated from said one or more divider panels by a proximal divider fold line and said distal inner panel being separated from said one or more divider panels by a distal divider fold line.

* * * * *